United States Patent [19]

Green et al.

[11] 4,286,135

[45] Aug. 25, 1981

[54] COMPACT MICROWAVE ISOLATOR

[75] Inventors: Jerome J. Green, Lexington; Daniel J. Masse, East Walpole, both of Mass.

[73] Assignee: Raytheon Company, Lexington, Mass.

[21] Appl. No.: 83,149

[22] Filed: Oct. 9, 1979

[51] Int. Cl.[3] ..... H05B 6/70; H01P 1/365

[52] U.S. Cl. ..... 219/10.55 F; 219/10.55 R; 219/10.55 A; 333/24.2

[58] Field of Search ..... 333/1.1, 24.1, 24.2; 219/10.55 R, 10.55 A, 10.55 F

[56] References Cited

U.S. PATENT DOCUMENTS

| | | | |
|---|---|---|---|
| 3,197,718 | 7/1965 | Sigrist et al. | 333/24.2 |
| 3,662,291 | 5/1972 | Cotter | 333/24.1 X |
| 3,670,134 | 6/1972 | Bucksbaum | 333/1.1 X |
| 3,922,620 | 11/1975 | Deutsch | 333/1.1 |

FOREIGN PATENT DOCUMENTS

| | | | |
|---|---|---|---|
| 1098557 | 2/1961 | Fed. Rep. of Germany | 333/24.2 |
| 1146147 | 3/1963 | Fed. Rep. of Germany | 333/24.1 |

*Primary Examiner*—Paul L. Gensler

*Attorney, Agent, or Firm*—Vincenzo D. Pitruzzella; Joseph D. Pannone; Milton D. Bartlett

[57] ABSTRACT

A resonance isolator in which microwave ferrite bars are positioned in and in contact with a waveguide to achieve unilateral absorption and in which ceramic permanent magnet bars are positioned on the outside of the waveguide adjacent to the ferrite bars and are insulated by a thin sheet of thermally insulating material that also acts as a spacer to adjust the magnetic field. The waveguide may be made with nonmagnetic sheet metal and the ferrite bars may be used as extruded. The isolator is adapted to connect between a microwave generator, such as a magnetron, and a microwave load, such as a heating chamber, and forms an integral feed unit. The isolator effectively reduces the peaks of the standing wave caused by the power reflected by a load and protects the generator against premature degradation and extends its useful life time. Preferably, the isolator structure is mounted on the heating chamber which forms a wall of the waveguide and a set of permanent magnets may be on the inside of the heating chamber and coated with a conductive layer to prevent absorption of energy. Magnetron cooling air may also be drawn through a waveguide for cooling and additionally for driving a mode stirrer in the heating chamber.

8 Claims, 4 Drawing Figures

FIG. 1A
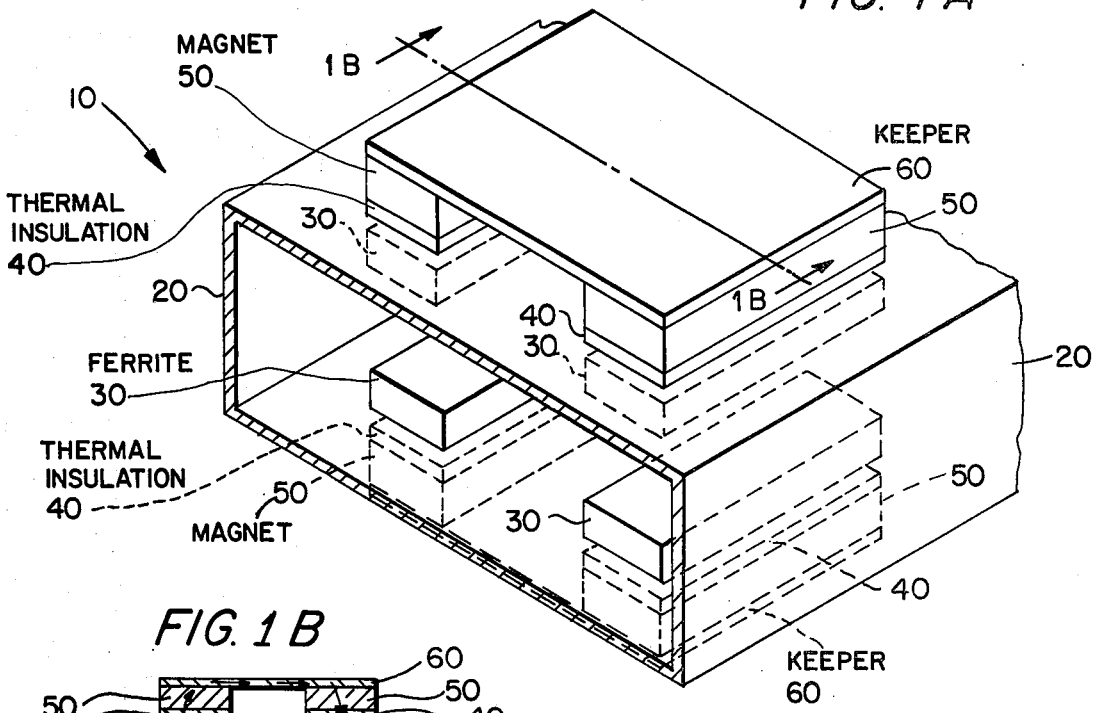
FIG. 1B
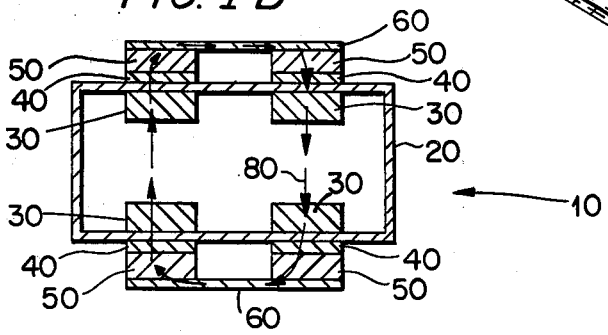
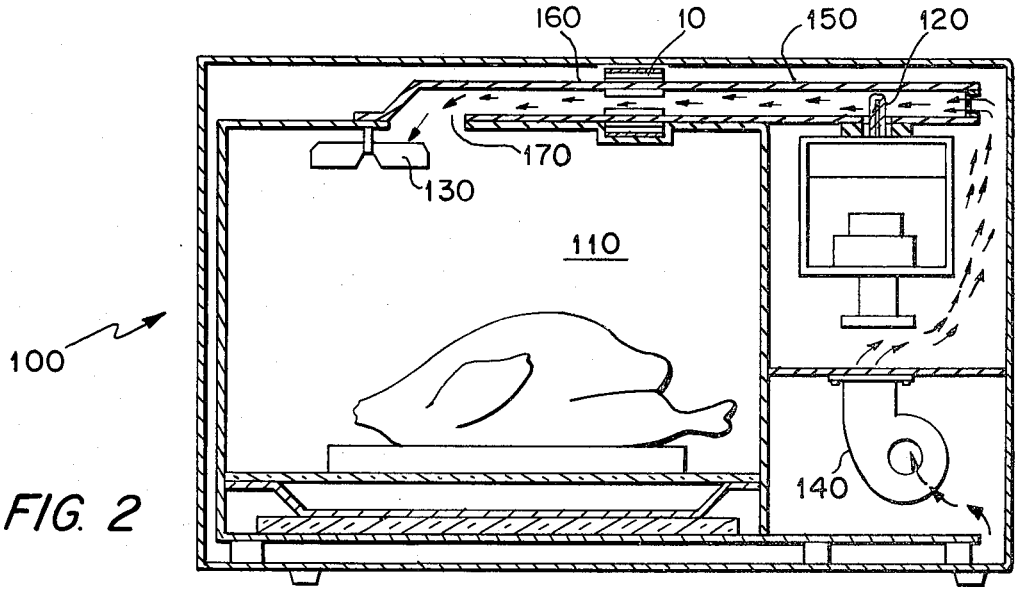
FIG. 2

COMPACT MICROWAVE ISOLATOR

BACKGROUND OF THE INVENTION

The use of isolators has been necessary to improve the stability of the microwave source in the presence of varying loads and to extend the life of the source of microwave energy, commonly a magnetron. The presence of varying loads results in an impedance mismatch that causes some of the energy to be reflected toward the source of microwave energy. When this energy reaches the tube it may, if of sufficient amplitude progressively destroy it or at least reduce considerably its lifetime. The energy reflected also causes a higher VSWR in the waveguide resulting in a peak electric field that can cause arcing unless the waveguide is of sufficient height.

In certain applications, microwave ovens for instance, it is very important to use an isolator that is compact, lightweight and that can be manufactured at the lowest possible cost. In conventional isolators, the power reflected by the load is absorbed by a resonance process in the ferrite material. The ferrite is heated and must be cooled efficiently to prevent its degradation. These isolators are bulky and use a heavy horseshoe-shaped permanent magnet to provide the required magnetic field. To reduce cost and weight, microwave ovens use a circulator to protect the magnetron. However, the circulators have a high isolation which prevents the mode stirrer from pulling the magnetron to achieve better heat uniformity, an important consideration in microwave heating.

SUMMARY OF THE INVENTION

In accordance with this invention, a transmission line has at least one ferrite bar in contact with a conducting surface thereof, and magnet means are positioned over the transmission line and adjacent to the ferrite bar. Means for thermally insulating the magnet means are disposed between the conducting surface and the magnet means.

Further, in accordance with this invention, a waveguide having a plurality of permanent bar magnets disposed in pairs of opposite polarity poles on the outside of opposite surfaces of the waveguide to obtain a magnetic field transverse to the propagation of microwave energy has a plurality of ferrite bar pairs within the waveguide to provide for better heat dissipation. Each of the ferrite bar pairs is disposed adjacent to a corresponding pair of said magnet pairs.

This invention further provides for a portion of a waveguide having at least one ferrite bar positioned within the waveguide and means for providing a static magnetic field through the ferrite bar. These means comprise a plurality of ceramic bar magnets disposed in pairs on the outside of opposite surfaces of the waveguide adjacent to the ferrite bar and a high permeability keeper positioned in contact with each of the magnet bar pairs to complete the magnetic circuit. Further, nonmagnetic spacer means can be positioned between the outside surfaces of the waveguide and the magnet bars.

This invention also discloses a waveguide isolator structure with a reduced height to obtain a smaller size and weight and to reduce the volume of the permanent magnets required. The waveguide is made of thin nonmagnetic metallic sheets for ease of manufacture and reduced cost.

This invention further discloses a waveguide isolator structure connected between a microwave source and a heating chamber so as to reduce the energy reflected into the microwave source. Additionally, the heating chamber may provide a fourth wall of the waveguide.

BRIEF DESCRIPTION OF THE DRAWINGS

These and other objects and advantages of the invention will be better understood from the following detailed description used in conjunction with drawings in which like reference numbers refer to like parts or items and in which:

FIG. 1A illustrates an isometric view of the isolator constructed in accordance with the invention.

FIG. 1B illustrates a cross-sectional view of the isolator of FIG. 1A taken along line 1B.

FIG. 2 illustrates a vertical cross-sectional view of the microwave oven utilizing a power delivery tube in accordance with this invention.

Figure 3:
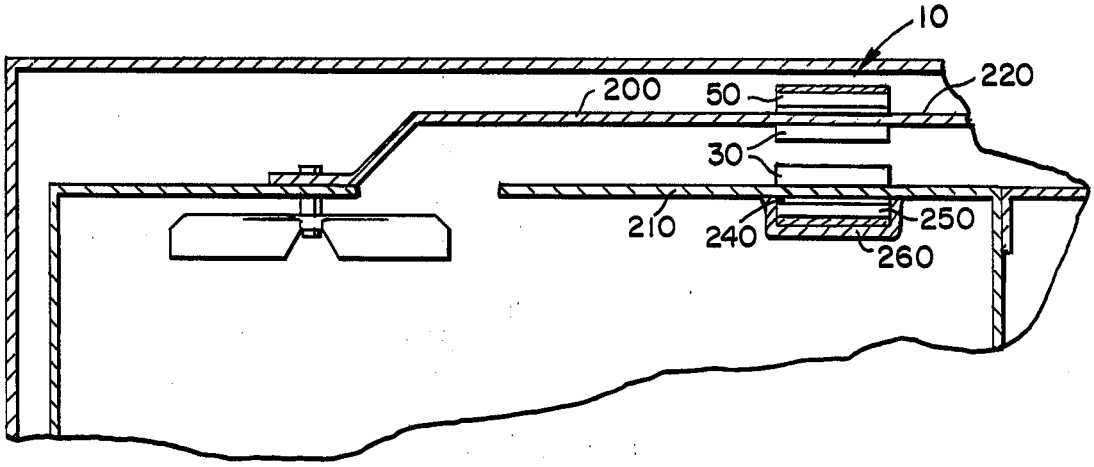
FIG. 3 illustrates a detailed view of a different embodiment of the power delivery tube.

The figures have not been drawn to scale, instead they have been exaggerated for purposes of illustration.

DESCRIPTION OF THE PREFERRED EMBODIMENT

Referring now to FIGS. 1A and 1B, there is shown an isolator structure 10 embodying the principles of the invention. A waveguide section 20 is used which may also include quarter-wave transformers or other matching structures when needed (not shown). Waveguide 20 can be manufactured with nonmagnetic sheet metal rather than being extruded. Ferrite bars 30 are bonded to the inner surfaces of the broad wall of waveguide 20 at a location which encompasses the plane where the magnetic field of the electromagnetic microwave has a component that is circularly polarized. This location is approximately at a distance from the edges of waveguide equal to one fourth of the waveguide width. This allows for the gyroresonant ferrite material to obtain isolation by unilateral absorption. The RF energy interacts with the gyroscopic nature of the ferrite's spinning electrons as a function of an externally applied magnetic field. The mechanism for the gyroresonant action of ferrites is well known to the art and does not need any further explanation. The arrangement of four thin ferrite bars 30 in contact with the waveguide 20 allows for a better dissipation of the heat generated by the absorption of microwave energy and for the use of shorter ferrite bars for a given amount of isolation. Ferrite bars 30 can be extruded and used without any additional machining since the surface irregularities of these bars are not critical for proper isolation. The transfer of heat by conduction to the waveguide 20, an effective heat sink, is enhanced by the use of a silicon rubber, such as RTV silastic 734, to make the ferrite 30 to waveguide 20 bond and compensate for any surface irregularity of the extruded ferrite bars 30.

Thin sheets of thermally insulating material, such as fiberglass 40, are bonded to the outside surface of the broad walls of waveguide 20. The purpose for this will become clear as the description progresses. Permanent ceramic bar magnets 50 are bonded to the fiberglass sheet 40 and are positioned so as to align over ferrite bars 30. The magnetic field generated by pairs of ceramic magnets 50 transverses the broad sides of waveguide 20 and is channeled through the ferrite bars 30. To obtain a very compact structure, the invention makes use of small light weight ceramic magnets having a high coercive force. The magnetic field is then contained within a small volume around the structure by the use of keepers 60. Keepers 60 can be made of any soft metal material having a high permeability, for example, cold rolled steel bars. The advantage of this is that a smaller and lighter overall net structure can be obtained. Keepers 60 are used to complete the magnetic circuit by providing a path of least resistance for the magnetic field. The field configuration of the magnetic field as provided by magnets 50 is shown in FIG. 1B by arrows 80.

To reduce the bulk, weight and cost of the isolator, small ceramic magnets fabricated in large quantities for the magneto of small gasoline engines can be used. A field of the order of 1300 gauss is obtained when the field gap is 0.5 inches. Thus, a reduced height waveguide section is built with internal dimensions a=4.300 inches and b=0.500 inches.

The reduced height waveguide can be manufactured with nonmagnetic sheet metal rather than being extruded, providing a lighter and less expensive waveguide. This is particularly useful when used in microwave ovens that also have the oven chamber manufactured with sheet metal. The use of four, shorter ferrite bars 30 also complements this waveguide design, since the shorter ferrite bars 30 can better adapt to any small deformation that might occur in the sheet metal waveguide. Reduced height waveguide 20 can be used to deliver microwave energy directly since the isolator also prevents arcing by absorbing enough of the reflected energy to lower the VSWR. Using the microwave energy delivery structure of FIG. 2 eliminates the need for quarter-wave transformers or other matching techniques to couple to a larger waveguide. A matching structure is needed to avoid energy reflections if a different microwave source coupling structure is used.

The isolator structure described utilizes low cost components and steps of manufacture, making it particularly suitable for large volume applications. Known methods of manufacture for isolators normally involve selecting a standard waveguide size then magnetizing a typical horseshoe magnet to achieve the required magnetic field inside the waveguide. The satisfy the requirements of a small, low-cost isolator for high volume needs, a different design method had to be found. This consists of first selecting small and inexpensive magnets. Ceramic magnet bars commercially available in large quantities are used. The magnetic field available from the selected magnets is measured and it provides one of the critical constraints. The size for the gap between two opposite poles is then selected which in turn determines the height of the waveguide. The waveguide is manufactured using thin sheet of nonmagnetic metal to further contribute to overall light weight and low cost. A ferrite material is then selected that has appropriate characteristics to achieve isolation in the available magnetic field and operating temperature ranges. Temperature insulation of magnets and magnetic field gap adjustments, to compensate for expected variations in the magnets, are obtained by using a sheet of fiberglass between the waveguide wall and the magnets.

In microwave heating applications, an ideal isolator for protecting a source of microwave energy, such as a magnetron tube, should have a low insertion loss in order to waste little of the microwave energy generated by the tube and should have enough isolation to protect the tube and extend its lifetime without preventing frequency pulling. In microwave heating, frequency pulling can be provided by a mode stirrer to achieve uniform heating. It was found that an isolator providing 3 dB of isolation adequately protects the tube, has a low insertion loss and does not prevent frequency pulling. Although the application of this invention is shown for microwave heating, the isolator described here is useful in many commercial applications, especially where a low cost unit is essential.

When used in a microwave oven, the typical power available from the magnetron is 600 watts CW. Thus, in the worst case, such as operation into a short circuit, the isolator must be able to dissipate 300 watts CW. It can be assumed that all the heat removal is done through the ferrite waveguide bond to the waveguide wall by conduction, and in most applications air used to cool the magnetron can be also used to cool the waveguide. An isolator was built using the principles of the present invention and was then tested. For an average thermal conductivity for ferrite of k=0.01 cgs units the temperature drop across the ferrite bar 30 is $\Delta T=34°$ C. The temperature drop across the bond when using RTV silicon rubber with $k=5\times10^{-4}$ cgs units is $\Delta T=17°$ C. It has also been found that the waveguide 20 itself gets heated to about 100° C. Thus, in a steady state condition of a short circuit at the output of the isolator the ferrite bar 30 is at a temperature of 150° C. The ferrite bars must be able to reach resonance in the magnetic field available, in this case 1300 gauss. For a microwave frequency of 2,450 MHz, typical for microwave ovens, the $4\pi M_s$ of the ferrite must be around 600 g. The ferrite bars must also have a Curie temperature high enough so that under high powr the ferrite properties will not degrade excessively.

An isolator having the required characteristics can be made with commercially available ferrite material, for example, Ampex 3-602 manufactured by Ampex, Inc. of Sunnyvale, Calif. Four ferrite slabs are used having the following characteristics:

| | |
|---|---|
| Dimensions (inches) | .075 × .400 × 2.000 |
| $4\pi M_s$ (g) | 600 |
| $\Delta H$ (oe) | 365 |
| $T_C$ (°C.) | 290 |

The isolator constructed with these ferrite bars has the following characteristics:

| | |
|---|---|
| Insertion loss (dB) | 0.25 |
| Isolation (dB) | 3.2 |

It has been discovered that the magnetic field supplied by the ceramic magnets decreases faster with increasing temperature than the $4\pi M_s$ of the ferrite. It has been found that satisfactory operation can be achieved by thermally insulating the magnets with a thin sheet of nonmetallic material, such as a fiberglass sheet 40. The thickness of the one used is 1/16 inch. Additionally, the fiberglass is used as a spacer to obtain the desired magnetic field strength. One of the advantages of its location is that the adjustment of the magnetic field is performed in the side where the spacer lowers the thermal flux to the magnets by diverting the bulk of this flux toward the waveguide 20.

FIG. 2 shows the use of the isolator structure 10 in an integral microwave energy delivery system 150 within microwave oven 100.

All the elements needed to deliver microwave energy into the heating cavity 110 are part of the integral feed tube 150. Microwave energy is supplied by microwave generator such as magnetron 120. It is coupled to waveguide 160 so as to deliver microwave energy into heating chamber 110 through feed point 170. Isolator structure 10 is in a section of waveguide 160 between generator 120 and feed point 170 and its permits microwave energy to pass from generator 120 to chamber 110, but causes energy reflected from chamber 110 along waveguide 160 to be absorbed by ferrites which form a part of isolator 10. Blower fan 140 is used to draw air past the microwave generator 120. This air can be also routed through waveguide 160 to provide additional cooling. Mode stirrer 130 can also be operated with the same drawn air by fan 140 or by a separate motor not shown. The integral feed tube just described can be manufactured as a unit that can be mounted on the oven and to which the magnetron is connected, thereby reducing overall manufacturing costs by reducing the number of separate parts.

FIG. 3 shows a different embodiment of the invention, that can be used when the heating chamber is made with non-magnetic sheet metal. The waveguide 200 consists of opposite narrow walls connected by broad wall 220. This structure can also be made by stamping thin nonmagnetic sheet metal. One of the oven walls 210 makes the other broad wall of the waveguide 200 when the waveguide 200 is mounted on the oven over wall 210. A set of magnets 50 are bonded on the outside of broad wall of waveguide 200 over a thin sheet of fiberglass. The fiberglass is used to thermally insulate the magnet so as to prevent the degradation of the magnetic field as the temperature increases. Another set of magnets 250 and insulating fiberglass sheet 240 are bonded on the inside surface of the broad wall 210 of the heating chamber. Magnets 250 and insulating sheets 240 can be covered with a layer of conductive material 260 so as not to absorb any microwave energy. A set of ferrite bars 30 is bonded on the inside of broad wall 220. Another set of ferrite bars 30 is bonded on the surface of broad wall 210 so as to be enclosed by the other three walls of waveguide 200. This embodiment allows for the simplest isolator structure since it eliminates one wall of the waveguide 200 by using the top of the heating chamber 110 to serve as a waveguide wall.

Other modifications to the described embodiments will be apparent to persons skilled in the art without departing from the spirit and scope of this invention. Accordingly, it is intended this invention be not limited except as defined by the appended claims.

What is claimed is:

1. In combination:

a portion of a waveguide having at least one ferrite bar positioned within said waveguide;

means for providing a static magnetic field through said ferrite bar, comprising a plurality of ceramic bar magnets disposed in pairs on the outside of opposite surfaces of said waveguide and adjacent said ferrite bar, and a high permeability keeper positioned in contact with each of said magnet bar pairs to complete the magnet circuit; and non-magnetic thermally insulating spacer means positioned between said outside surfaces of said waveguide and said magnet bars.

2. In combination:

a section of waveguide;

at least one ferrite bar in contact with an inside surface of said waveguide;

a plurality of ceramic bar magnets disposed in pairs on the outside of opposite surfaces of said waveguide and adjacent to said ferrite bar so as to channel a static magnetic field through said ferrite;

high permeability keeper means for containing said magnetic field positioned in contact with said magnet bars; and non-magnetic means for thermally insulating said magnets positioned between said magnets and said waveguide.

3. The combination of claim 2 wherein:

said section of waveguide is made with nonmagnetic sheet metal.

4. The combination of claim 2 wherein:

said ferrite bar is used as extruded.

5. In combination:

a section of waveguide including a pair of opposite broad walls;

at least one ferrite bar in contact with one of said broad walls and disposed longitudinally within said waveguide in the region where substantial gyroresonance absorption takes place;

a plurality of slender ceramic magnet bars disposed longitudinally on the outside of said opposite broad walls positioned so as to provide a transverse magnetic field to said ferrite bar;

at least one high permeability keeper disposed on the outside of said waveguide in contact with opposite poles of said magnet bars positioned on said broad walls; and at least one thin sheet of thermally insulating nonmagnetic material disposed between at least one of said magnet bars and said broad walls of said waveguide.

6. The combination of claim 5 wherein:

said section of waveguide is adapted to connect between a source of microwave energy and a load.

7. In combination:

a source of microwave energy;

an enclosure;

a waveguide adapted to be connected between said energy source and said enclosure having a pair of opposite broad walls;

at least one ferrite bar positioned to be in contact with one of said broad walls and disposed longitudinally within said waveguide in the region where gyroresonance absorption takes place;

at least one thin sheet of thermally insulating nonmagnetic material positioned to be in contact with the outer surface of said broad wall and adjacent to said ferrite bar;

at least one set of ceramic bar magnets disposed on the outside of said broad walls and positioned over said insulating sheet to provide a transverse magnetic field through said ferrite bar; and at least one keeper disposed on the outside of said broad wall and in contact with opposite poles of said set of magnets disposed on said broad wall.

8. In combination:

a source of microwave energy;

a heating chamber;

a three-sided waveguide having a pair of opposite narrow walls connected by a broad wall and adapted to be connected between said energy source and said heating chamber and disposed such that said heating chamber provides a second broad wall for said waveguide;

at least one ferrite bar positioned to be in contact with one of said broad walls and disposed longitudinally within said waveguide in the region where gyroresonance absorption takes place;

a plurality of magnets disposed on the outside surface of said broad walls to provide a transverse magnetic field through said ferrite bar; and means for thermally insulating said magnets positioned between said outside surface and said magnets.

* * * * *